US008874009B2

(12) United States Patent
Noguchi et al.

(10) Patent No.: US 8,874,009 B2
(45) Date of Patent: Oct. 28, 2014

(54) DEVELOPING DEVICE HAVING DUAL FEEDING CHAMBERS

(75) Inventors: Akihiro Noguchi, Toride (JP); Katsuya Nose, Matsudo (JP); Asuna Fukamachi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 13/276,597

(22) Filed: Oct. 19, 2011

(65) Prior Publication Data

US 2012/0099900 A1 Apr. 26, 2012

(30) Foreign Application Priority Data

Oct. 20, 2010 (JP) ..... 2010-235437
Aug. 4, 2011 (JP) ..... 2011-171086

(51) Int. Cl.
*G03G 15/08* (2006.01)
*G03G 15/09* (2006.01)

(52) U.S. Cl.
CPC .... *G03G 15/0822* (2013.01); *G03G 2215/0822* (2013.01); *G03G 2215/0838* (2013.01); *G03G 2215/0844* (2013.01); *G03G 15/09* (2013.01)
USPC ..... 399/254; 399/252; 399/257; 399/258; 399/259; 399/260

(58) Field of Classification Search
USPC ..... 399/252, 254, 257, 258, 259, 260
See application file for complete search history.

(56) References Cited

U.S. PATENT DOCUMENTS

| | | | |
|---|---|---|---|
| 4,498,246 | A | 2/1985 | Cantu et al. |
| 7,263,318 | B2 | 8/2007 | Nishihama et al. |
| 7,277,649 | B2 | 10/2007 | Hirobe et al. |
| 7,349,653 | B2 | 3/2008 | Nishihama et al. |
| 7,362,989 | B2 | 4/2008 | Nishihama et al. |
| 7,386,261 | B2 | 6/2008 | Noguchi et al. |

(Continued)

FOREIGN PATENT DOCUMENTS

| | | | |
|---|---|---|---|
| JP | 9-319223 | A | 12/1997 |
| JP | 10-31363 | A | 2/1998 |

(Continued)

*Primary Examiner* — Ryan Walsh
(74) *Attorney, Agent, or Firm* — Fitzpatrick, Cella, Harper & Scinto

(57) ABSTRACT

A developing device includes a developer carrying member for carrying developer containing a non-magnetic toner and a magnetic carrier to a position where the developer carrying member is opposed to an image bearing member, and a developing container including a first chamber for accommodating the developer to be supplied to the developer carrying member, a second chamber provided below the first chamber, and an opening for circulating the developer between the first chamber and the second chamber. In addition, a first feeding member and a second feeding member are rotatably provided in the first chamber and the second chamber, respectively, for stirring and feeding the developer. A first magnet member of the first feeding member and a second magnet member of the second feeding member are provided so that same magnetic polarity portions are opposed to each other or so that a ratio of a range in which the same magnetic polarity portions are opposed to each other is greater than a ratio of a range in which opposite magnetic polarity portions are opposed to each other.

4 Claims, 6 Drawing Sheets

(56) References Cited

U.S. PATENT DOCUMENTS

| | | | | |
|---|---|---|---|---|
| 7,421,226 | B2 | 9/2008 | Suenami et al. | |
| 7,630,670 | B2 | 12/2009 | Nishihama et al. | |
| 7,664,435 | B2 | 2/2010 | Nose | |
| 7,881,638 | B2 | 2/2011 | Noguchi et al. | |
| 2005/0244195 | A1* | 11/2005 | Hirobe et al. | 399/269 |
| 2006/0257162 | A1 | 11/2006 | Suenami et al. | |
| 2010/0196056 | A1* | 8/2010 | Ohkawa et al. | 399/254 |
| 2011/0052220 | A1 | 3/2011 | Nose | |
| 2011/0052233 | A1* | 3/2011 | Sakamaki | 399/254 |

FOREIGN PATENT DOCUMENTS

| | | | |
|---|---|---|---|
| JP | 11-52731 | A | 2/1999 |
| JP | 2003-57929 | A | 2/2003 |
| JP | 2004-191469 | A | 7/2004 |
| JP | 2006-317564 | A | 11/2006 |
| JP | 2007-304141 | A | 11/2007 |
| JP | 2008-116723 | A | 5/2008 |
| JP | 2009-151103 | A | 7/2009 |

* cited by examiner (a)

(b)

DEVELOPING DEVICE HAVING DUAL FEEDING CHAMBERS

FIELD OF THE INVENTION AND RELATED ART

The present invention relates to a developing device for visualizing a latent image formed on an image bearing member by a developer, and an image forming apparatus of an electrophotographic type or an electrostatic recording type, such as a copying machine, a laser beam printer, a facsimile machine, a complex machine combining one or more of them, or the like.

As a color image forming apparatus, a tandem type in which a plurality of image forming stations are arranged and a single drum type in which a plurality of developing devices are provided for one image bearing member are known. In the tandem type image forming apparatus, a developing device provided for each image forming station, where a toner image is formed in an associated color. On the other hand, in a single drum type image forming apparatus, different ones of the developing devices are opposed to the single drum to form different color images. For this purpose, the developing devices are supported by a rotatable member, and the rotatable member is rotated to oppose different developing devices to the image bearing member.

As for a developer usable with the developing device, a developer containing toner and carrier particles is used. Such a developing device includes the developing container for accommodating the developer, and a developing sleeve for carrying the developer from the developing container to a developing zone for the image bearing member. The developing container includes a developer chamber for supplying the developer to the developing sleeve, a stirring chamber juxtaposed with the developer chamber, and a reception bridging portion for relaying or transferring the developer between the developer chamber and the stirring chamber. The developer chamber and the stirring chamber are each provided with a feeding screw for stirring and feeding the developer.

The feeding screw stirs and feeds the developer to circulate the developer between the stirring chamber and the developer chamber. By doing so, the toner and the carrier are rubbed and stirred with each other to electrically charge the toner. The developer fed to the developer chamber is carried on the developing sleeve, and develops an electrostatic latent image formed on the image bearing member.

It is known that a blade of the feeding screw is provided with a magnetic member at a tip end or that a part of the feeding screw is a permanent magnet (Japanese Laid-open Patent Application 2007-304141, Japanese Laid-open Patent Application 2003-57929). In a structure in which the developer chamber and the stirring chamber are arranged vertically, it is known that a belt having a plurality of magnets is trained around said developer container and is rotated to improve the feeding performance of the developer from a lower side chamber to an upper side chamber (Japanese Laid-open Patent Application Hei 9-319223).

In the case of the structure in which the developer is circulated through the reception bridging portion, the developer may not be transferred in the reception bridging portion with the result of stagnation of the developer, in some cases. If the stagnation of the developer occurs, charging non-uniformity of the toner may result, which may lead to an image defect, developer overflow, screw locking or the like. In the case of the structure disclosed in Japanese Laid-open Patent Application 2007-304141, Japanese Laid-open Patent Application 2003-57929, the supply of the developer to the developing sleeve, and the developer feeding through the gap between the feeding screw and the container are satisfactory. However, only by the provision of the magnetic member on the feeding screw, the developer feeding performance between the developer chamber and the stirring chamber is not always assisted, and therefore, the stagnation of the developer in the reception bridging portion is still possible.

On the other hand, with the structure disclosed in Japanese Laid-open Patent Application Hei 9-319223, the following problem may arise. When the use amount of the toner is small as in the case that a great number of low image density output images are formed, toner deterioration occurs such as removal or embedding of externally added material, or the like. Under such conditions, a shear plane where flow speed of the developer is different with the result that and toner and the carrier are separated from each other, and therefore, toner agglomeration masses are easily produced. Then, the developer may be packed at the position of a blade for regulating a carrying amount of the developer.

For example, such a shear plane appears upstream of the blade with respect to a rotational moving direction of the developing sleeve, due to the flow speed difference of the developer. In the shear plane, the toner agglomeration mass grows with the result that a clearance between the toner agglomeration mass and the developing sleeve is smaller than the clearance between the blade and the developing sleeve. As a result, the developer carrying amount becomes smaller than the expected regulated amount by the blade. The reduction of the carrying amount may cause an image defect such as density non-uniformity.

In the case of the structure disclosed in Japanese Laid-open Patent Application Hei 9-319223, by moving the outside magnet of the developing container, the developer confined by the magnet is moved. In such a case, however, it is not avoidable that a shear plane is produced due to a flow speed difference in the developer between the developer confined by the magnet and the developer fed by the feeding screw. As a result, a toner agglomeration mass is produced at the shear plane, and if the toner agglomeration mass is carried to the blade portion, the developer coating amount on the developing sleeve becomes insufficient.

Japanese Laid-open Patent Application Hei 10-31363 discloses a developing device in which the developer in the developing container is vertically transferring for circulation, and the developer is scooped up by magnet rollers arranged vertically, and the developer carried on the upper side magnet roller is scraped off by the regulating blade. However, similarly to Japanese Laid-open Patent Application Hei 9-319223, a shear plane is formed by a boundary between a stationary layer region and of the feeding region by the magnet roller.

SUMMARY OF THE INVENTION

It an object of the present invention to provide a developing apparatus in which a toner agglomeration mass is not easily formed, and the developer feeding performance is proper at position where the developer is transferred into another portion.

According to an aspect of the present invention, there is provided a developing device comprising a developer carrying member for carrying the developer containing non-magnetic toner and magnetic carrier to a position where said developer carrying member is opposed to an image bearing member; a developing container including a first chamber for accommodating a developer to be supplied to said developer carrying member, a second chamber provided below said first chamber, and a pair of transferring portions for circulating the developer between said first chamber and said second chamber; a first feeding member and a second feeding member, rotatably provided, in said first chamber and said second chamber, respectively, for stirring and feeding the developer; and a magnetic member provided at least on said first feeding member, wherein said magnetic member is provided in a region opposing at least one of said transferring portions where the developer is scooped from said second chamber into said first chamber.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Figure 1:
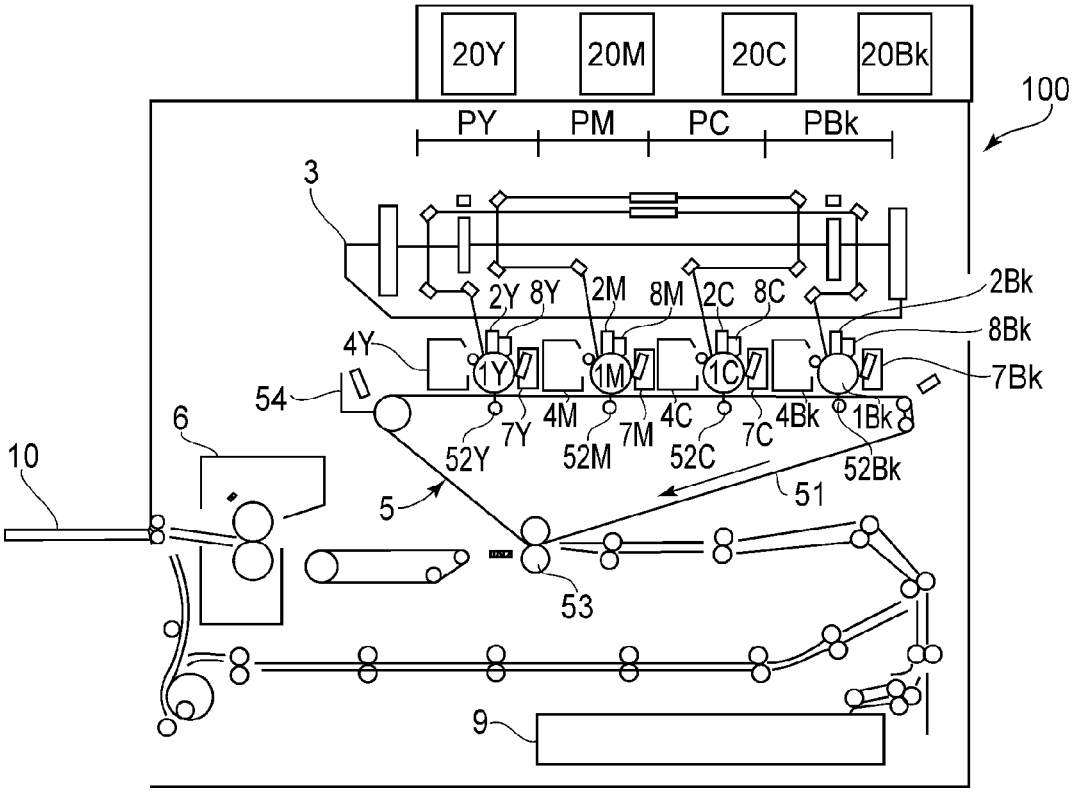
FIG. 1 is a schematic sectional view of an image forming apparatus according to a first embodiment the present invention.

First, referring to FIGS. 1-5, the first preferred embodiment of the present invention is described. To begin with, the overall structure of the image forming apparatus in this embodiment is described with reference to FIG. 1.

[Image Forming Apparatus]

An image forming apparatus 100 forms images based on the information of an image to be formed. The information is given to the image forming apparatus by a reading device connected to the main assembly of the image forming apparatus 100, or a host device, such as a personal computer, which is in connection to the main assembly of the apparatus 100 in such a manner that communication is possible between the host device and the main assembly of the apparatus 100. The image forming apparatus 100 in this embodiment can electrophotographically form full-color images on recording medium (sheet of recording paper, a sheet of plastic, piece of fabric, etc.). The full-color image is based on four primary colors, more specifically, yellow (Y), magenta (M), cyan (C), and black (Bk) colors.

Thus, the image forming apparatus 100 is provided with multiple image forming means. More specifically, it has the first to fourth image forming stations PY, PM, PC, and PBk, which form yellow, magenta, cyan, and black monochromatic images, respectively. The four image forming stations are in the so-called tandem alignment. The image forming apparatus 100 is also provided with a transferring device 5, which is an image transferring means. The transferring device 5 is provided with an intermediary transfer belt 51, which is circularly moved in the direction indicated by an arrow mark, along each image forming station. While the intermediary transfer belt 51 is moved as described above, the four monochromatic toner images formed in the four image forming stations, one for one, are layered on the intermediary transfer belt 51. Then, the layered four monochromatic toner images, different in color, on the intermediary transfer belt 51 are transferred onto recording medium to obtain a copy of the image to be formed.

More specifically, each of the multiple (four) image forming stations is provided with a photosensitive member 1 and a developing device 4. It forms monochromatic images of a specific color. The intermediary transfer belt 51 which is an image transferring intermediary member is moved along each image forming station so that its image bearing surface, that is, the surface onto which a toner image formed by each image forming station is transferred, faces the image forming station. The four image forming stations are sequentially aligned in the direction parallel to the direction in which the image bearing surface of the intermediary transfer belt 51 moves. Incidentally, the image forming apparatus 100 may be provided with a recording medium conveyance belt, instead of the intermediary transfer belt 51. The recording medium conveyance belt is a recording medium conveying member for conveying a sheet of recording medium, onto which toner images are transferred. That is, although the image forming apparatus 100 in this embodiment is of the so-called intermediary transfer type, the present invention is also applicable to an image forming apparatus of the so-called direct transfer type, each image forming station of which transfers a toner image directly onto recording medium. In the case of an image forming apparatus of the direct transfer type, its image forming stations are in alignment in the direction in which the image bearing surface of the recording medium conveyance belt moves along the image forming stations.

The four image forming stations are virtually the same in structure, although they are different in the color of the developer they use. Thus, in the following description of the image forming stations P, the suffixes Y, M, C, and K which indicate the colors of the monochromatic images which the four image forming stations form, one for one, are not going to be shown, so that the four image forming stations can be described together. Further, the image forming apparatus 100 in this embodiment uses two-component developer, that is, developer made up of nonmagnetic toner and magnetic carrier.

The image forming station P has the photosensitive member 1 (photosensitive drum) as an image bearing member. The image forming station P has: a charging device 2 as a charging means; an exposing device 3 as an exposing means (optical exposing system based on laser, for example); a developing device 4 as a developing means; a transferring device 5; a cleaning device 7 as a cleaning means; and a charge removing device 8 as a charge removing means. These devices are in the adjacencies of the peripheral surface of the photosensitive member 1.

The transferring device 5 has the intermediary transfer belt 51 as an intermediary transferring member. The intermediary transfer belt 51 is supported and kept stretched by multiple rollers, and is circularly moved in the direction indicated by the arrow mark in FIG. 1. Further, the image forming apparatus 100 is provided with multiple (four) primary transferring members 52, which oppose the four photosensitive members 1, one for one, with the presence of the intermediary transfer belt 51 between each primary transferring member 1 and corresponding photosensitive member 1. Further, the image forming apparatus 100 is provided with a secondary transferring member 53, which is positioned so that it opposes one of the rollers by which the intermediary transfer belt 51 is supported and kept stretched.

The image forming operation performed by the image forming apparatus 100 is as follows. First, the peripheral surface of the photosensitive member 1 is uniformly charged by the charging device 2 while the photosensitive member 1 is rotated. Next, the uniformly charged portion of the peripheral surface of the photosensitive member 1 is scanned (exposed) by a beam of light projected by the exposing device 3 while being modulated with electrical signals generated based on the information of the image to be formed, whereby an electrostatic latent image is effected on the peripheral surface of the photosensitive member 1. This electrostatic latent image on the photosensitive member 1 is developed into a visible image, that is, an image formed of toner, by the developing device 4 and the developer therein. As the developer in the developing device 4 is consumed for the development of the electrostatic latent image, the developer in a hopper 20 is delivered into the developing device 4 through a replenishment developer delivery passage (unshown), by an amount equal to the amount of developer consumption for the latent image development. After the formation of the toner image on the peripheral surface of the photosensitive member 1, the toner image is transferred (primary transfer) onto the intermediary transfer belt 51 by the primary transfer bias applied to the primary transferring member 52, in the first transfer station (primary transfer nip), in which the intermediary transfer belt 51 is in contact with the peripheral surface of the photosensitive member 1. For example, in a case where the image forming apparatus 100 is used for forming a full-color image by layering four monochromatic toner images, different in color, the four monochromatic toner images, different in color, are sequentially formed in the four image forming stations P, starting from the first image forming station Py, for example. Then, the four monochromatic images are sequentially transferred in layers onto the intermediary transfer belt 51 from the four image forming stations, one for one. As a result, a full-color image, that is, a combination of layered four monochromatic toner images, different in color, is effected on the intermediary transfer belt 51.

Meanwhile, one of the sheets of recording medium in a cassette 9 is conveyed to the second transfer station (nip between intermediary transfer belt 51 and secondary transferring member 53), by recording medium conveying members, such as a pickup roller, a recording medium conveyance roller, a pair of registration rollers, and the like, with such a timing that the sheet of recording medium arrives at the secondary transfer station at the same time as the toner image on the photosensitive member 1. Then, as the sheet of recording medium is conveyed through the secondary transfer station, the secondary transfer bias is applied to the secondary transferring member 53. Thus, the combination of the layered four monochromatic toner images on the intermediary transfer belt 51 is transferred onto the sheet of recording medium by the function of the secondary transfer bias.

Thereafter, the sheet of recording medium is separated from the intermediary transfer belt 51, is conveyed to a fixing device 6, and is conveyed through the fixing device 6. While the sheet of recording medium, on which the layered four monochromatic toner images (of which full-color image is made) are present, is conveyed through the fixing device 6, the monochromatic toner images are subjected to the heat and pressure applied thereto by the fixing device 6. Thus, the monochromatic toner images melt and become fixed to the sheet of recording medium while mixing. Thereafter, the sheet of recording medium is discharged from the image forming apparatus 100.

After the primary transfer of a toner image from the photosensitive member 1, a certain amount of residues, such as toner particles, remain on the peripheral surface of the photosensitive member 1. These residues are recovered by the cleaning device 7. Further, the residual electrostatic latent image on the photosensitive member 1 is erased by the charge removing device 8. Through these cleaning processes, the photosensitive member 1 is prepared for the formation of the next image. As for the residues, such as toner particles, which are on the intermediary transfer belt 51 after the secondary transfer, are removed by a cleaner 54 dedicated to the cleaning of the intermediary transfer belt 51.

Incidentally, not only is the image forming apparatus 100 capable of forming multicolor images with the use of two or more of the four image forming stations, but also, monochromatic images with the use of only one of the four image forming stations.

[Two-Component Developer]

Next, the two-component developer used by the image forming apparatus 100 in this embodiment is described. The toner contains particles made up of bonding resin, coloring agent, and internal additives (which are added as necessary). It contains also microscopic external additives such as colloidal silica. It is made of polyester, and is negative in intrinsic polarity. It is desired to be no less than 5.0 μm and no more than 8.0 μm in volume average particle diameter d (5.0 μm≤d≤8.0 μm). The toner used by the image forming apparatus 100 in this embodiment was 7.0 μm in the volume average particle diameter d. It contained wax. The amount of the wax in the toner was in a range of 1-20 wt. %. The toner was made by mixing at least binder resin, coloring agent, wax, and then, pulverizing the mixture.

As the material for the carrier, superficially oxidized or non-oxidized particles of a metallic substance, such as iron, nickel, cobalt, manganese, chrome, and one of rare-earth metals, etc., their alloys, oxidized ferrite, and the like, can be used with preferable results. The method for manufacturing these magnetic particles does not need to be limited to a specific one. The carrier is desired to be in a range of 20.0-60.0 μm, preferably 30.0-50.0 μm, in volume average particle diameter D (20.0 μm≤D≤60.0 μm, preferably, 30.0 μm≤D≤50.0 μm). It is desired to be no less than $10^7$ Ω·cm, preferably, $10^8$ Ω·cm, in resistivity. The carrier used by the image forming apparatus 100 in this embodiment was 40 μm in volume average particle diameter D, $5\times10^8$ Ω·cm in resistivity, and 260 emu/cc ($260\times10^3$ A/m) in the amount of magnetization.

The volume average particle diameter of the developer was measured with the use of the following apparatus and method. The apparatus was a Coulter Counter TA-II (product of Beckman Coulter Inc.), to which an interface (product of Japan Chemical Engineering & Machinery Co., Ltd.) for outputting the numerical and volume average distributions of the developer, and a personal computer, were connected. The electrolyte was 1% water solution of first class sodium chloride.

The method used for obtaining the volume average particle diameter of the developer is as follows. That is, 0.1 ml of surfactant, preferably, alkyl-benzene sulfonate, was added, as dispersant, into 10-150 ml of abovementioned electrolyte. Then, 0.5-50 mg of a test sample (developer) was added to the mixture of the electrolyte and surfactant. Then, the electrolyte in which the test sample was suspended was subjected to an ultrasonic dispersing device for roughly 1-3 minutes to evenly disperse the test sample in the electrolyte. Then, the distribution of the particles which were in a range of 2-40 μm in diameter was obtained with the use of the Coulter Counter TA-II fitted with a 100 μm aperture, and the volume average particle distribution of the developer was obtained from the numerical average distribution of the developer. Then, the volume average particle diameter of the developer was obtained from the volume average particle distribution of the developer.

As for the amount of the resistivity of the magnetic carrier, it was measured using the following method. That is, a preset amount of the developer was placed in a cell of the so-called sandwich type, which was 4 cm in the size of each of its measurement electrodes, and was 0.4 cm in the gap between the electrodes. Then, the amount of the resistivity of the carrier was obtained from the amount of the electric current which flowed through the electric circuit while 1 kg of weight was applied to one of the electrodes and a voltage E (V/cm) was applied between the two electrodes. The volume average particle diameter of the magnetic carrier was obtained with the use of a particle size distribution measuring device HEROS of the laser diffraction type (NEC Corp.); the particle diameter range of 0.5-350 μm, based on volume basis, was logarithmically divided into 32 decades, and the number of particles in each decade was measured. Then, from the results of the measurement, the median diameter of 50% in volume of the carrier was used as the volume average particles diameter of the magnetic carrier.

The magnetic properties of the magnetic carrier were obtained with the use of an instrument BHV-30 (product of Riken Denshi Co., Ltd.) for automatically recording properties of oscillatory magnetic field. The magnetic strength of the magnetic carrier was obtained by forming external magnetic fields, which were 595.7 kA/m and 79.58 kA/m, respectively. The magnetic carrier samples were made by packing the magnetic carrier in a cylindrical container to a preset amount of density. Then, the samples were measured in magnetic moment. Further, the samples were weighed to obtain the amount of magnetic strength (emu/g) of the magnetic carrier. Further, the true specific gravity of the magnetic carrier was obtained with the use of a Micromeritics Pycnometer Accupyc 1330 (product of Shimazu Co., Ltd), which is an automatic densitometer of the dry type), or the like instrument. The magnetic strength of the carrier was obtained by multiplying the amount of the magnetic strength of the magnetic carrier per volumetric unit by the true specific gravity.

[Developing Device]

Figure 2:
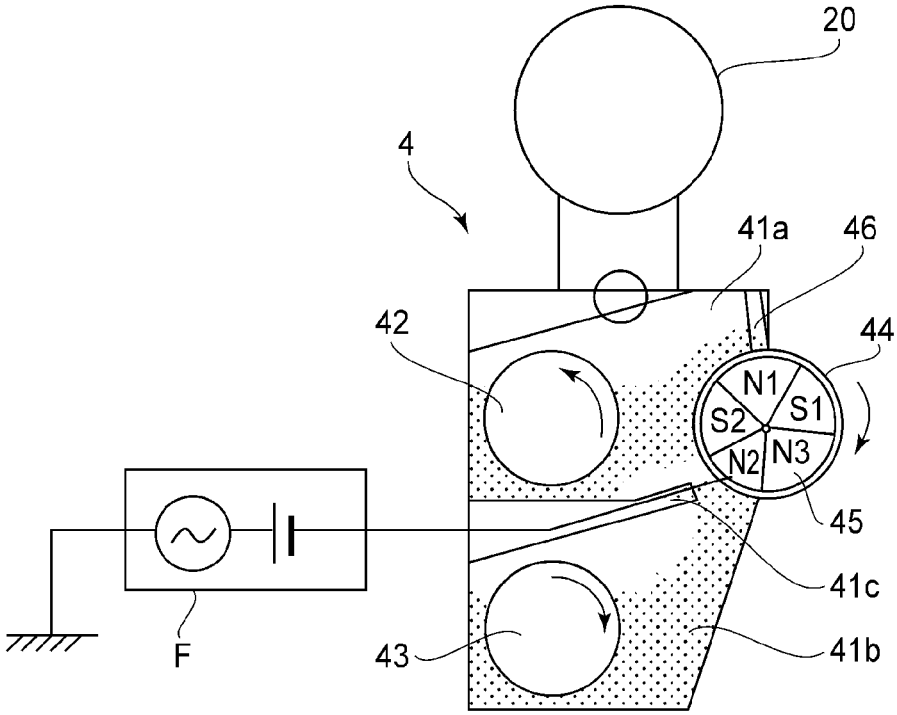
FIG. 2 is a schematic cross-sectional view of the developing device.
Figure 3:
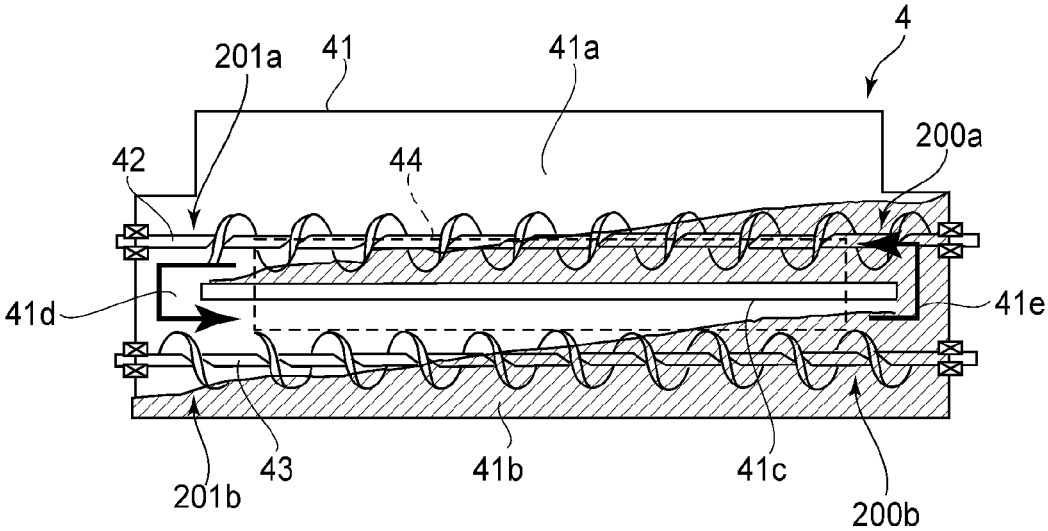
FIG. 3 is a longitudinal sectional view of the developing device.

Next, referring to FIGS. 2 and 3, the developing device 4 is described. The developing device 4 has an external shell 41 (container), in which the two-component developer made up of toner and carrier is stored. The developing device 4 has also a development sleeve 44 and a blade 46. The development sleeve 44 is a developer carrying means, and is positioned in the shell 41 in such a manner that it faces the photosensitive member 1. The blade 46 is for regulating in thickness the developer layer on the peripheral surface of the development sleeve 44, and is also in the shell 41.

The developing device shell 41 has two chambers, more specifically, a development chamber 41*a* (first chamber) and a stirring chamber 41*b* (second chamber). The development chamber 41*a* is on top of the stirring chamber 41*b*. The two chambers 41*a* and 41*b* are separated from each other with a partition wall 41*c*, which is at roughly the middle of the shell 41 in terms of the vertical direction of the shell 41, and extends in the direction perpendicular to the surface of the sheet of paper on which FIG. 2 is present, and the direction perpendicular to the surface of the sheet of paper on which FIG. 3 is present.

The development chamber 41*a* and stirring chamber 41*b* are provided with the first and second developer conveyance screws 42 and 43, which are the first and second developer conveying members, respectively. The first developer conveyance screw 42 as the first developer conveying member (which hereafter may be referred to simply as first conveyance screw 42) is in the bottom portion of the development chamber 41*a*, and is roughly parallel to the axial line of the development sleeve 44. It conveys, while stirring, the developer in the development chamber 41*a* in only one direction, which is parallel to the axial line of the development sleeve 44, by being rotated in the direction (counterclockwise direction) indicated by an arrow mark in FIG. 2. The reason why the first conveyance screw 42 is rotated in the counterclockwise direction is that the counterclockwise direction is advantageous from the standpoint of supplying the development sleeve 44 with the developer. As for the second developer conveyance screw 43 as the second developer conveying member (which hereafter may be referred to simply as conveyance screw 43), this is in the bottom portion of the stirring chamber 41*b*, and is roughly parallel to the first conveyance screw 42. It conveys, while stirring, the developer in the stirring chamber 41*b* by being rotated in the opposite direction from the direction in which the first conveyance screw 42 is rotated. The direction in which the developer conveyance screw 43 conveys the developer is opposite from the direction in which the developer in the development chamber 41*a* is conveyed by the first conveyance screw 42.

Thus, as the developer in the development chamber 41*a* and the developer in the stirring chamber 41*b* are conveyed by rotation of the first and second conveyance screws 42 and 43, respectively, the developer in the shell 41 is circularly moved in the developing device shell 41 through the development chamber 41*a*, stirring chamber 41*b*, and a pair of openings 41*d* and 41*e* (pair of developer transfer passages) with which the lengthwise ends of partition wall 41*c* are provided one for one. The aforementioned hopper 20 is where the replenishment toner of a specific color is held. That is, each developing device shell 41 is replenished with developer by the corresponding hopper 20.

The developing device shell 41 has an opening which faces the photosensitive member 1. The opening corresponds in position to the development area where an electrostatic latent image on the photosensitive member 1 is developed. It is through this opening that the development sleeve 44 is partially exposed toward the photosensitive member 1. That is, the development sleeve 44 opposes the photosensitive member 1 through this opening in such a manner that there is only a preset small distance between its peripheral surface and the peripheral surface of the photosensitive member 1. For example, assuming that the development sleeve 44 are photosensitive member 1 are 20 mm and 80 mm, respectively, in diameter, the distance between the peripheral surface of the development sleeve 44 and that of the photosensitive member 1 is roughly 300 μm. Thus, as the developer is conveyed by the development sleeve 44 to the development area, the developer layer on the peripheral surface of the photosensitive member 1 comes into contact with the peripheral surface of the photosensitive member 1, and develops the electrostatic latent image on the peripheral surface of the photosensitive member 1.

The development sleeve 44 is made of a nonmagnetic substance such as aluminum and stainless steel. There is a magnetic roller 45 in the hollow of the development sleeve 44. The magnetic roller 45 is a means for generating a magnetic field, and is stationary (non-rotational). It has five magnetic poles S1, N3, N2, S2, and N1. The magnetic pole S1 is the development pole, which faces the photosensitive member 1, in the development area. The magnetic poles are in the listed order in terms of the rotational direction (clockwise direction indicated by arrow mark) of the development sleeve 44.

The development process carried out by the developing device 4 is as follows. While the development sleeve 44 is rotated, the developer is borne on the peripheral surface of the development sleeve 44 by the magnetic force of the magnetic roller 45. Then, as the development sleeve 44 is rotated further, the magnetic brush, that is, the developer layer borne on the peripheral surface of the development sleeve 44, is regulated in thickness by the blade 46, and is conveyed to the development area where the peripheral surface of the development sleeve 44 faces the peripheral surface of the photosensitive member 1, and supplies the peripheral surface of the photosensitive member 1 with the developer to develop the electrostatic latent image on the peripheral surface of the photosensitive member 1 into a visible image.

For development efficiency, that is, in order to increase the developing device 4 in the efficiency with which it adheres the developer to the peripheral surface of the photosensitive member 1 in the pattern of the electrostatic latent image, a development bias, which is a combination of DC and AC voltages, is applied to the development sleeve 44 from an electric power source F. In this embodiment, the DC voltage was −500 V, whereas the AC voltage was 800 V in peak-to-peak voltage, and 12 kHz in frequency. However, this embodiment is not intended to limit the present invention in terms of the value of the DC voltage, and the value and waveform of the AC voltage. Generally speaking, a developing method which relies on a magnetic brush formed of two-component developer can be improved in development efficiency, by the application of AC voltage to a development sleeve (44). Thus, the application of the AC voltage to a development sleeve (44) enables an electrophotographic image forming apparatus (100) to output images of higher quality. However, it is likely to cause an electrophotographic image forming apparatus (100) to output foggy images. Therefore, in order to prevent the image forming apparatus 100 from outputting foggy images, a certain amount of difference in value is provided between the DC voltage applied to the development sleeve 44 and the voltage level (which corresponds to white areas of resultant image) to which the peripheral surface of the photosensitive member 1 is charged.

The development sleeve 44 of the developing device 4 is rotated in such a manner that the direction in which its peripheral surface moves in the development area becomes the same as the direction in which the peripheral surface of the photosensitive member 1 moves in the development area, and also, that the ratio between the peripheral velocity of the development sleeve 44 and that of the photosensitive member 1 becomes 1.75. This peripheral velocity ratio between the development sleeve 44 and photosensitive member 1 is desired to be in a range of 0.5-2.5, preferably, 1.0-2.0. The greater the peripheral velocity ratio, the higher the development efficiency. However, if it is greater than a certain value, such problems as toner scatter, toner deterioration, and the like occur. This is why the peripheral velocity ratio between the development sleeve 44 and photosensitive member 1 is desired to be set to a value in the abovementioned range.

The blade 46 is a component for regulating in thickness the developer layer on the peripheral surface of the development sleeve 44. It is made of a plate of nonmagnetic substance such as aluminum. It is positioned so that it extends in the direction parallel to the lengthwise direction (axial line) of the development sleeve 44. In terms of the rotational direction of the development sleeve 44, it is on the upstream side of the development area. As the development sleeve 44 is rotated, the developer layer on the peripheral surface of the development sleeve 44 is conveyed through the gap between the developer layer regulating edge of the blade 46 and the peripheral surface of the development sleeve 44 so that both the toner and carrier of the developer are conveyed to the development area. Thus, the amount by which the developer is conveyed to the development area by the development sleeve 44 can be adjusted by adjusting the gap between the developer layer regulating edge of the blade 46 and the peripheral surface of the development sleeve 44, since the amount by which the developer is allowed to reach the development area is proportional to the thickness of the magnetic brush (developer layer) on the peripheral surface of the development sleeve 44, which is controlled by the blade 46. For example, the amount by which the developer is allowed to remain coated (to reach development area) per unit area of the peripheral surface of the development sleeve 44 is regulated to 30 mg/cm$^2$ by the blade 46. The gap between the developer layer regulating blade 46 and development sleeve 44 is desired to be in a range of 200-1,000 μm, preferably, 300-700 μm. In this embodiment, it was set to 500 μm.

[Developer Transfer Passages]

Figure 4:
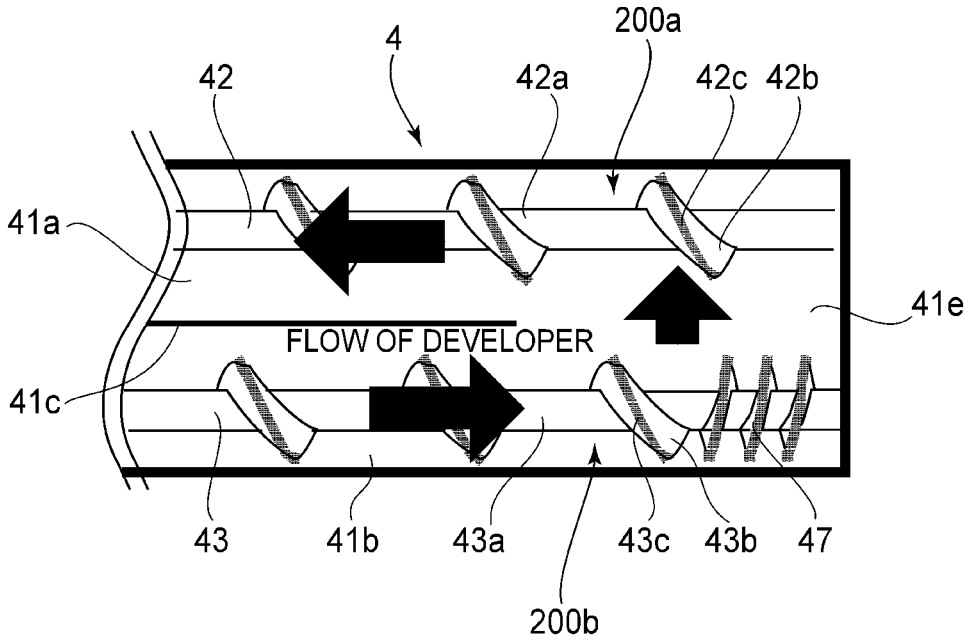
FIG. 4 is a view (a) of a right-hand portion in FIG. 3, and a partly enlarged view (b).
Figure 4:
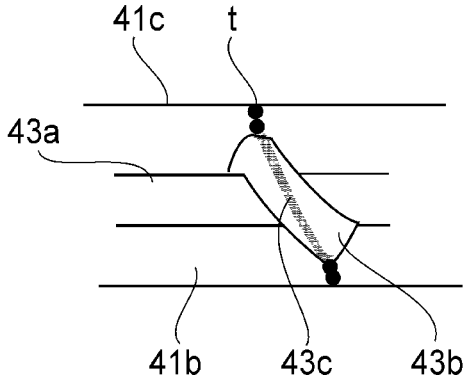
Figure 5:
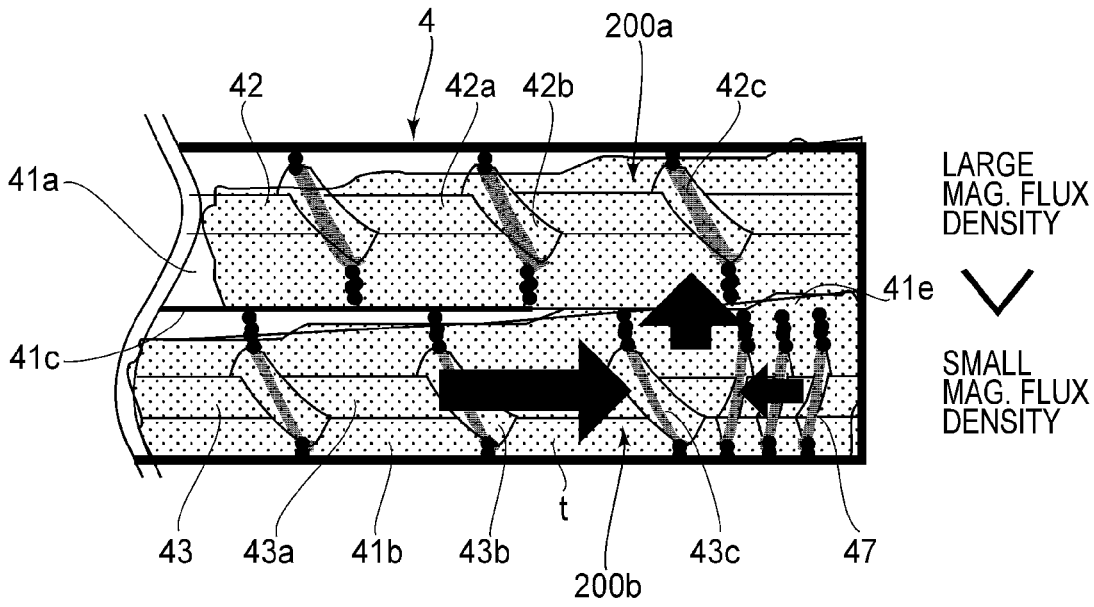
FIG. 5 is a schematic enlarged view of a right-hand portion of the FIG. 3, illustrating flow of the developer in the transferring portion.

Next, referring to FIGS. 4 and 5, the developer transfer passages 41*d* and 41*e*, which are between the development chamber 41*a* and stirring chamber 41*b*, and their adjacencies, are described about their structure. The developer transfer passage 41*d* is the passage through which the developer is transferred from the development chamber 41*a* into the stirring chamber 41*b*, and the developer transfer passage 41*e* is the passage through which the developer is transferred from the stirring chamber 41*b* into the development chamber 41*a*. The first and second conveyance screws 42 and 43 in this embodiment have rotational shafts 42*a* and 43*a*, and spiral blades 42*b* and 43*b*, respectively. The spiral blades 42*a* and 43*a* are fitted around the rotational shafts 42*a* and 43*a*, respectively. Further, the spiral blades 42*a* and 43*a* are fitted with permanent magnets 42*c* and 43*c* (magnetic members), which are at the ridge of the blade 42*a* and the ridge of the blade 43*a*, respectively, extending from one end of the ridge to the other. The permanent magnets 42*c* and 43*c* are in the form of a magnetic wire having multiple magnetic poles S and N, which are preset in length (6 mm in pitch) and are randomly positioned. More specifically, the ridge portion of each of the spiral blades 42*b* and 43*b* is provided with a groove, and the permanent magnet 43 is fitted in the groove in such a manner that the magnet 43 does not protrude beyond the ridge of the spiral blade 42.

However, the permanent magnets 42*c* and 43*c* may be slightly protrusive from the ridges of the spiral blade 42*b* and 43*b*, as long as the clearance between the developer conveyance screw 42 and the shell 41 and the clearance between the developer conveyance screw 43 and the shell 41 are proper. The reason why the permanent magnets 42*c* and 43*c* are structured so that their S poles and N poles are randomly positioned is as follows. It is rather difficult to manufacture a long magnet (magnetic wire), the magnetic poles on one of opposing two primary surfaces of which are the same in polarity and uniform in magnetic flux density. Further, even if it can be done, the manufacturing cost therefor is rather high.

In comparison, a long magnet (magnetic wire), the S and N poles of which are randomly positioned in terms of the lengthwise direction of the magnet, is low in manufacture cost.

As for the second conveyance screw 43 which is to be placed in the stirring chamber 41*b*, that is, the bottom chamber of the developing device shell 41, not only is it provided with the spiral blade 43*b*, but also, a spiral blade 47 (counter-conveyance blade), which is opposite in angle from the spiral blade 43*c*. Thus, as the developer conveyance screw 43 is rotated, the spiral blade 47 conveys the developer in the opposite direction from the direction in which the developer is conveyed by the spiral blade 43*c*. The spiral blade 47 in this embodiment is provided with a magnet 43*c*, which is fitted in the groove of the ridge portion (peak portion) of the spiral blade 47.

The portion of the first developer conveyance screw 42, which corresponds in position to the developer transfer passage 41*e*, is provided with the magnetic portion 200*a*, whereas the portion of the second developer conveyance screw 43, which corresponds in position to the developer transfer passage 41*e*, is provided with the magnetic portion 200*b*. Further, a part, or parts, of the magnetic portion 200*a*, are different in polarity from the counterpart, or counterparts, of the magnetic portion 200*b*. That is, in terms of the lengthwise direction of the developing device 4, the magnetic portions 200*a* and 200*b* correspond in position to the developer transfer passage 41*e*, through which the developer is transferred from the stirring chamber 41*b* to the development chamber 41*a*. In this embodiment, the portion of the developer conveyance screw 42, which corresponds in position to the developer transfer passage 41*d*, and the portion of the developer conveyance screw 43, which corresponds in position to the developer transfer passage 41*d*, are provided with magnetic portions 201*a* and 201*b*, respectively, as shown in FIG. 3. However, the portion of the developer conveyance screw 42, which corresponds in position to the developer transfer passage 41*d*, and the portion of the developer conveyance screw 43, which corresponds in position to the developer transfer passage 41*e*, do not need to be provided with a magnetic portion.

The magnetic portions 200*a* and 201*a* are parts of the permanent magnet 42*c*, and the magnetic portions 200*b* and 201*b* are parts of the permanent magnet 43*c*. In this embodiment, the developer conveyance screws 42 and 43 are structured so that the S poles and N poles of their permanent magnets 42*c* and 43*c* are randomly positioned in terms of the lengthwise direction of the magnets 42*c* and 43*c*, and also, so that at least a part of the magnetic portions 200*a* is opposite in polarity from the counter part of the magnetic portion 200*b*, and at least a part of the magnetic portion 201*a* is opposite in polarity from the counterpart of the magnetic portion 201*b*. Here, "a part of the magnetic portion 200*a* is opposite in polarity from the counter part of the magnetic portion 200*b*" includes a case in which as the developer conveyance screws 42 and 43 are rotated, a part of the magnetic portion 200*a* becomes opposite in polarity from the counterpart of the magnetic portion 200*b*, or the same in magnetic polarity as the counterpart of the magnetic portion 200*b*. Further, the developing device 4 may be structured so that as the developer conveyance screws 42 and 43 are rotated, the point at which a part of the magnetic portion 200*a* becomes opposite in magnetic polarity from the counterpart of the magnetic portion 200*b* shifts in the direction parallel to the axial lines of the two screws 42 and 43. Moreover, the developing device 4 may be structured so that regardless of the rotation of the developer conveyance screws 42 and 43, at least a part of the magnetic portion 200*a* remains opposite in magnetic polarity from the counterpart of the magnetic portion 200*b*, as long as the downstream side in terms of the direction in which the developer is moved through the developer transfer passage is greater in magnetic force than the upstream side.

The developing device 4 is desired to be structured so that the frequency with which a part, or parts, of the magnetic portion 200*a* become opposite in magnetic pole to the counterpart, or counterparts, of the magnetic portion 200*b* is higher than the ratio with which a part, or parts, of the magnetic portion 200*a* are the same in magnetic pole to the counterpart, or counterparts, of the magnetic portion 200*b*, and also, so that a part, or parts, of the magnetic portion 201*a* are opposite in magnetic pole to the counterpart, or counterparts, of the magnetic portion 201*b* is higher than the frequency with which a part, or parts, of the magnetic portion 201*a* become the same in magnetic pole to the counterpart, or counterparts, of the magnetic portion 201*b*. That is, in this embodiment, the developer conveyance screws 42 and 43 are roughly the same in rotational speed, and the ratio between the frequency with which the magnetic poles of the developer conveyance screw 42 oppose the magnetic poles of the developer conveyance screw 43, which are opposite in magnetic pole from those of the developer conveyance screw 42, and the frequency with which the magnetic poles of the developer conveyance screw 42 oppose the magnetic poles of the developer conveyance screw 43, which are the same in magnetic pole as those of the developer conveyance screw 42, is desired to be no less than 50%, preferably, no less than 60%, more preferably, no less than 70%. This ratio is desired to be set in consideration of the rotational speed of the developer conveyance screw 42 and that of the developer conveyance screw 43.

Further, the developing device 4 is structured so that the magnetic portions 200*a* and 201*b*, which are the downstream magnetic portions in terms of the developer conveyance direction through the developer transfer passages, are greater in magnetic flux density than the magnetic portion 200*b* and 201*a*, which are the upstream magnetic portions. The downstream magnetic portions 200*a* and 201*b* are at the downstream end of the developer transfer passages 41*d* and 41*e*, respectively, in terms of the developer conveyance direction, whereas the upstream magnetic portions 200*b* and 201*a* are at the upstream end of the developer transfer passages 41*d* and 41*e*, respectively, in terms of the developer conveyance direction. That is, the permanent magnet 42*c* with which the spiral blade 42*b* of the first conveyance screw 42 is provided is designed so that its magnet portion 200*a*, which faces the developer transfer passage 41*e*, is higher in magnetic flux density than its magnetic portion 200*b*, which faces the developer transfer passage 41*d*. Further, the permanent magnet 43*c* with which the spiral blade 43*b* of the second conveyance screw 43 is provided is designed so that its magnetic portion 200*b*, which faces the developer transfer passage 41*e*, is lower in magnetic flux density than its magnetic portion 201*a*, which faces the developer transfer passage 41*d*.

Incidentally, in a case where the portion of the first conveyance screw 42, which faces the developer transfer passage 41*d*, and the portion of the second conveyance screw 43, which faces the developer transfer passage 41*d*, are not provided with the magnetic portion, the permanent magnet 42*c* of the first conveyance screw 42 has only to be made higher in magnetic flux density than the permanent magnet 43*c* of the second conveyance screw 43, so that at least, the portion of the first developer conveyance screw 42, which corresponds in position to the downstream magnetic portion 200*a*, is higher in magnetic flux density than the portion of the second developer conveyance screw 43, which corresponds in position to the upstream magnetic portion 200*b*. The amount of the difference between the magnetic flux density of the downstream magnetic portion 200*a* and that of the upstream magnetic portion 200*b* is desired to be in a range of 5-100 mT (millitesla (50-1,000 Gauss), preferably, 200-60 mT (200-600 Gauss).

In the case of the developing device 4 in this embodiment which is structured as described above, the ridge portion of the first developer conveyance screw 42*b*, and the ridge portion of the second developer conveyance screw 43*b*, are provided with the permanent magnets 42*c* and 43*c*, respectively. Therefore, the developer t is borne by the first and spiral blades 42*b* and 43*b* and crests as shown in FIGS. 4(*b*) and 5. Therefore, not only can the developing device 4 in this embodiment more efficiently convey the developer which is in the portion of the development chamber 41*a*, which corresponds to the clearance between the first developer conveyance screw 42 and the developing device shell 41 (inward surface), and the developer which is in the portion of the stirring chamber 41*b*, which corresponds to the clearance between the second developer conveyance screw 43 and the shell 41, but also, is significantly smaller in the amount of developer waste, than any conventional developing device.

To elaborate, in this embodiment, the clearance between the first developer conveyance screw 42 and the developing device shell 41, and the clearance between the second developer conveyance screw 43 and the shell 41, are made greater than those of any of the conventional developing devices of the similar type, for the following reason. That is, if the clearance between a developer conveyance screw and the wall of the developer container in which the screw is placed is very small, various problems occur. For example, the friction between the developer and the developer conveyance screw and/or shell 41 causes the developer to cluster, and, these developer clusters show up as parts of a finished image. Further, the large developer clusters cause a developing device to generate abnormal noises.

On the other hand, a developing device like the developing device 4 in this embodiment, which is used by an image forming apparatus of the tandem type, is different from a developing device which is installed in the developing device rotary of an image forming apparatus of the single drum type, in that it is not rotated (made to orbit) about the axis of the rotary. Therefore, the developer which is in the immediate adjacencies of the inward surface of the shell of a developing device like the one in this embodiment is likely to fail to be sufficiently stirred by the developer conveyance screws in the shell, and/or become stagnant by failing to be conveyed by the developer conveyance screws. In the case of a developing device which is installed in the rotary of an image forming apparatus of the single drum type and is rotationally moved about the axis of the rotary, the developer in the developing device is likely to be kept fluid by the orbital movement of the developing device, and therefore, even the developer in the corners of the developing device shell where the developer conveyance screws do not reach, is successfully conveyed while being fully stirred, that is, without becoming stagnant.

On the other hand, a developing device which is to be installed in an image forming apparatus of the tandem type remains stationary (does not orbitally move). Therefore, the developer which is in the portion of the shell of a developing device of this type, which is beyond the reach of the ridge of the developer conveyance screw in terms of the diameter direction of the screw, is not stirred and/or conveyed. Therefore, the developer in the abovementioned portions of the developing device shell remains stagnant, with the toner particles in the developer insufficiently charged. If the developer in the above-described condition happens to be conveyed with an unpredictable timing and for some reasons, it is supplied to the development sleeve 44 before it is fully charged. Consequently, it is likely to cause an image forming apparatus to output images which appear nonuniform. Further, in the case of a developing device of this type, as a developer conveyance screw is rotated, the body of developer, which is conveyable by the screw, is sheared away from the body of developer, which is outside the reach of the screw in terms of the diameter direction of the screw, and therefore, cannot be conveyed. Thus, it is possible that as the rotation of the screw continues, the toner particles in the developer cluster, and the developer clusters (toner particles of larger size) causes an image forming apparatus to output defective images, that is, images having developer clusters.

Further, a developing device shell is not variable in developer capacity, and therefore, the maximum amount by which the developer is storable in the shell is also not variable. The amount by which the developer is stored in a developing device has significant effects upon the service life of the developer in the developing device, and therefore, the intervals with which the developing device has to be maintained. Therefore, it is desired that a developing device is structured so that no developer therein fails to be conveyed and stirred. That is, a developing device is desired to be structured so that it waste no developer. Further, in the very near future, the market for a color image forming apparatus is likely to shift toward those of the tandem type, because of their faster operational speed. Therefore, it cannot be afforded not to minimize the amount by which the developer in a developing device is unusable, that is, not to efficiently use all the developer delivered into the developing device shell.

Thus, in this embodiment, permanent magnets 42*c* and 43*c* are placed in the grooves of the spiral blades 42*b* and 43*b* of the developer conveyance screws 42 and 43, respectively. Therefore, even through the image forming apparatus 100 in this embodiment is of the tandem type, its developing device 4 can satisfactorily convey even the body of developer, which is in the immediate adjacencies of the developing device shell. Therefore, the toner in the developing device 4 is supplied to the development sleeve 44 after being fully charged. Therefore, the image forming apparatus 100 is enabled to output images which are uniform in appearance. Further, not only is the developing device 4 in this embodiment unlikely to cause the developer therein to cluster, preventing thereby the image forming apparatus 100 from outputting images having toner particles (developer particles) of abnormally large sizes, but also, is significantly smaller in the amount of developer waste than any developing device based on the conventional art.

Further, as a given body of developer in the stirring chamber 41*b* is conveyed, while being stirred by the developer conveyance screw 43, near to the downstream end of the second conveyance screw 43 in terms of the developer conveyance direction, it collides with the body of developer, which has begun to be conveyed upstream by the spiral blade 47 (counter-conveyance portion) of the second conveyance screw 43. The collision creates such force that works in the direction to shoot the developer upward. Thus, as a body of developer in the stirring chamber 43 is conveyed to the point of the abovementioned developer collision, it is conveyed (shot up) into the development chamber 41*a* through the developer transfer passage 41*e* (opening of partition wall).

In this embodiment, the developing device 4 is structured so that the downstream magnetic portion 200*a* and upstream magnetic portion 200*b* oppose each other across the developer transfer passage 41*e*, and also, so that at least one of the magnetic poles of the magnetic portion 200*a* opposes the magnetic pole, or poles, of the magnetic portion 200*b*, which are opposite in magnetic polarity from the magnetic pole, or poles, of the magnetic portion 200*a*. Therefore, a magnetic field is generated between the magnetic portions 200*a* and ump 200*b*, in such a manner that magnetic fluxes connect the two magnetic portions 200*a* and 200*b*. Since the downstream magnetic portion 200*a* is made higher in magnetic flux density than the upstream magnetic portion 200*b* as described above. Therefore, such a magnetic force that works in the direction to assist the developer movement (transfer) from the stirring chamber 41*b* into the development chamber 41*a* through the developer transfer passage 41*e*. Therefore, the developer is prevented from becoming stagnant in the developer transfer passage 41*e*.

Further, in a case where the ridge portion of the first conveyance screw 42 and the ridge portion of the second conveyance screw 43 are not provided with a permanent magnet, the dimension of the developer transfer passage in terms of the lengthwise direction of the developer conveyance screws is desired to be set to a value which is roughly equal to the pitch of the first conveyance screw 42, in order to minimize the amount by which the developer stagnates in the developer transfer passage 41*e*. However, reducing the developer transfer passage in dimension in terms of the lengthwise direction of the developer conveyance screws reduces the amount by which the developer is pushed up into the development chamber 41*a*, whereas if the developer transfer passage is increased in dimension in terms of the lengthwise direction of the developer conveyance screws, more specifically, if the dimension of the developer transfer passage in terms of the developer conveyance direction is made greater than the pitch of the first conveyance screw 42, as a body of developer is scooped up (pushed up) into the development chamber 41*a* through the developer transfer passage 41*e*, it is caught by the first conveyance screw 42, is made to reach where it can fall back into the stirring chamber 41*b* through the developer transfer passage 41*e* by a single rotation of the first conveyance screw 42, and returns to the second conveyance screw 43 through the developer transfer passage 41*e*. In other words, when the dimension of the developer transfer passage 41*e* is either larger or smaller than the proper size for the passage 41*e*, the developer is likely to stagnate by a substantial amount at the developer transfer passage 41*e*.

In this embodiment, therefore, the ridge portion of the spiral blade 42*b* of the first developer conveyance screw and the ridge portion of the spiral blade 43*b* of the second developer conveyance screw, were provided with the permanent magnet. Thus, it is possible to impede to some degree the problem that if the dimension of the developer transfer passage 41*e* in terms of the developer conveyance direction is larger than the pitch of the first conveyance screw 42, gravity causes the developer to fall back into the stirring chamber 41*b* from the development chamber 41*a*. Conversely, providing the ridge portion of the spiral blade of the developer conveyance screw with the permanent magnet allows the developer transfer passage 41*e* to be increased in the dimension in terms of the developer conveyance direction, and increasing the developer transfer passage 41*e* in the abovementioned dimension is beneficial in that it increases the efficiency with which the developer can be transferred from the second conveyance screw 43 to the first conveyance screw 42. In terms of the developer conveyance direction, at least the portion of the first conveyance screw 42, which corresponds in position to the developer transfer passage 41*e* and is provided with the permanent magnet, needs to be greater in dimension in terms of the lengthwise direction of the developing device 4 than the developer transfer passage 41*e*. If the portion of the first conveyance screw 42, which is provided with the permanent magnet is less in dimension in terms of the lengthwise direction of the developing device than the developer transfer passage 41*e*, it is impossible to prevent the developer from falling through the portion of the developer transfer passage 41*e*, which corresponds in position to the magnet-free portion of the first conveyance screw 42. Therefore, the present invention is not as effective as it could be.

TABLE 1

| Openings & Conditions | Amount in developer chamber | Amount in stirring chamber | Ratio |
|---|---|---|---|
| 0.5 pitch without permanent magnet | 175 g | 325 g | 35:65 |
| 0.5 pitch with permanent magnet | 185 g | 315 g | 37:63 |
| 1 pitch without permanent magnet | 200 g | 300 g | 40:60 |
| 1 pitch with permanent magnet | 215 g | 285 g | 43:57 |
| 2 pitches without permanent magnet | 175 g | 325 g | 35:65 |
| 2 pitches with permanent magnet | 230 g | 270 g | 46:54 |

Table 1 shows the relationship between the presence and absence of the permanent magnet on the first conveyance screw, and the amount by which the developer was transferred from the stirring chamber into the development chamber, and the relationship between the dimension of the developer transfer passage in terms of the lengthwise direction of the developing device, and the mount by which the developer was transferred from the stirring chamber into the development chamber. As for the amount by which the developer was transferred, a preset amount of the developer was placed in the developing device 4, and the amount of the developer in the development chamber 41*a*, and the amount of the developer in the stirring chamber 41*b*, were measured after the development sleeve 44, developer conveyance screw 42, and developer conveyance screw 43 were rotated for a preset length of time at constant rotational speeds under various conditions. It was assumed that increase in the amount of the developer in the development chamber 41*a* indicates the increase in the amount by which the developer is transferred. As for the aforementioned various conditions, the amount of the developer in the developing device, excluding the developer on the development sleeve, was 500 g, and the speed of the development sleeve was 500 mm/s. Further, the speed of each developer conveyance screw was 600 mm/s. The following is evident from Table 1. That is, in the case where the development conveyance screws were not provided with the permanent magnet, the amount of the developer in the development chamber 41*a* was largest when the dimension of the developer transfer passage 41*e* in terms of the lengthwise direction of the developing device was the same as the pitch of the screws, whereas in the case where the development conveyance screws were provided with the permanent magnet, the amount of the developer in the development chamber 41*a* was the largest when the dimension of the developer transfer passage 41*e* was equal to twice the pitch of the screws. Further, the amount of the developer in the development chamber 41*a*, that is, the amount by which the developer was transferred, was greater when the developer conveyance screws were provided with the permanent magnet than when they were not. Further, if the ratio between the amount of the developer in the development chamber and that in the stirring chamber is no more than 40:60, a significant amount of developer stagnates at the developer transfer passage 41*e*. It is possible to make the developer transfer passage 41*e* longer in terms of the lengthwise direction of the developing device. However, if the developer transfer passage 41*e* is made long enough to reach beyond the developer bearing portion of the development sleeve 44, the developer which has just been used for development, being therefore lower in toner density, is supplied to the development sleeve 44 too soon. Therefore, the image forming apparatus 100 outputs images which are nonuniform in density in terms of the direction parallel to the lengthwise direction of the development sleeve 44. Therefore, the dimension of the developer transfer passage 41*e* in terms of the lengthwise direction of the developing device 4 needs to be no more than the value beyond which the developer bearing surface of the development sleeve 44 does not overlap with the developer transfer passage 41*e* in terms of the lengthwise direction of the developing device 4. As described above, in the case of the developing device in this embodiment, the developer transfer passage 41*e* does not overlap with the developer bearing surface of the development sleeve 44, and the ratio between the amount of the developer in the development chamber 41*a* and the amount of the developer in the stirring chamber 41*b* was no less than 40:60. Further, the dimension of the developer transfer passage 41*e* in terms of the lengthwise direction of the developing device 4 was made to be equal to twice the pitch of the developer conveyance screws, which made the largest the amount by which the developer was transferred from the stirring chamber 41*b* up into the development chamber 41*a*.

In this embodiment, it is the developer conveyance screws that are provided with the magnet. Therefore, the abovementioned shear plane, along which toner particles (developer particles) cluster, does not occur. Therefore, the image forming apparatus 100 is unlikely to output images which suffer from the nonuniformity attributable to the abnormally large toner particles (developer particles) generated along the shear plane. More specifically, in this embodiment, unlike the developing device structured as described in the aforementioned third document (Japanese Laid-open Patent Application H09-319223), the developing device 4 does not move the developer therein while confining the developer with the magnet in addition to the developer conveyance screws. Therefore, the developing device 4 in this embodiment does not create the shear plane, that is, a virtual plane, along which the toner particles (developer particles) are clustered. Therefore, the developing device 4 in this embodiment does not cause the image forming apparatus 100 to output images which suffer from the nonuniformity attributable to the abnormally large toner particles (developer particles). This phenomenon occurs also at the developer transfer passage 41*d*. In the case of the developer transfer passage 41*d*, however, the developer transfer is assisted by gravity. Therefore, as described above, the portion of the developer conveyance screw 42, which corresponds in position to the developer transfer passage 41*d*, and the portion of the developer conveyance screw 43, which corresponds in position to the developer transfer passage 41*d*, do not need to be provided with the magnetic portion.

In particular, the toner used by the developing device 4 in this embodiment contains wax. Therefore, as the developer deteriorates, the wax, which is sticky, tends to transfer to the surface of a toner particle, making it easier for toner particles to adhere to each other. Thus, it becomes easier for the toner particles to cluster. In comparison, the developing device 4 in this embodiment does not create the shear plane, along which toner particles are made to cluster. Therefore, it is unlikely to cause the toner to cluster even if the toner contains wax. Therefore, it is unlikely to cause the image forming apparatus 100 to output images which are nonuniform in appearance.

Further, in the case of the developing device 4 in this embodiment, the ridge portion of the spiral blade 42*b* of the developer conveyance screw 42, and the ridge portion of the spiral blade 43*b* of the developer conveyance screw 43, are provided with the permanent magnets 42*c* and 43*c*, respectively. Therefore, not only is it effective to prevent the developer from significantly stagnating at the developer transfer passages, but also, it is effective to minimize the problem that the developer conveyance screws lock up, and/or the problem that the developer overflows from the developing device.

Further, providing the ridge portion of the spiral blade 42*b*, and the ridge portion of the spiral blade 43*b*, with the permanent magnets 42*c* and 43*c*, respectively, is likely to causes the permanent magnets 42*c* and 43*c* to confine the developer in the developer transfer passages 41*e* and 41*d*, and therefore, are likely to impede the developer flow from the development chamber 41*a* into the stirring chamber 41*b* through the developer transfer passage 41*d*, and the developer flow from the stirring chamber 41*b* into the development chamber 41*a* through the developer transfer passage 41*e*. Therefore, the developer is likely to stagnate in the developer transfer passages 41*d* and 41*e*, increasing thereby the amount of the load to which the developer conveyance screws 42 and 43 are subjected. Further, it is possible for the developer to overflow from the developing device shell 41 and/or for the developer conveyance screws 42 and 43 to lock up.

In comparison, in the case of the developing device 4 in this embodiment, even through the ridge portion of the developer conveyance screw 42, and the ridge portion of the developer conveyance screw 43, are provided with the permanent magnets 42*c* and 43*c*, respectively, the magnetic portions 200*a* and 200*b*, which correspond in position to the developer transfer passage 41*e*, respectively, and the magnetic portions 201*a* and 201*b*, which correspond in position to the developer transfer passage 41*d*, are made different in magnetic flux strength. This difference in the magnetic flux strength assists the developer transfer through the developer transfer passages 41*d* and 41*e*, and therefore, the developer is unlikely to significantly stagnate at the developer transfer passages 41*d* and 41*e*. Therefore, the developing device 4 in this embodiment is unlikely to suffer from the problem that its developer conveyance screws lock up and/or the developer overflows therefrom.

Further, the development chamber 41*a* and stirring chamber 41*b* of the developing device 4 in this embodiment are vertically stacked. Therefore, in order to transfer the developer from the stirring chamber 41*b* up into the development chamber 41*a* through the developer transfer passage 41*e*, the developer has to be conveyed against gravity. Therefore, the above described developer stagnation is likely to occur at the developer transfer passage 41*e*. In the case of the developing device 4 in this embodiment, however, the difference in magnetic flux density between the magnetic portion 200*a*, that is, the downstream magnetic portion in terms of the developer conveyance direction through the developer transfer passage 41*e*, and the magnetic portion 200*b*, that is, the upstream magnetic portion, was set to a value in a range of 5-100 mT, preferably, 20-60 mT, in order to minimize the developer stagnation at the developer transfer passage 41*e*.

The reason why the magnetic flux density difference was set to be no less than 5 mT is that the effects of gravity was taken into consideration. That is, in order to ensure that the developer is desirably conveyed through the developer transfer passage 41*e*, the amount of the resultant force of the combination of the amount of the force generated by the magnetic field generated by the downstream magnetic portion 200*a* and upstream magnetic portion 200*b*, and the amount of the gravitational force, needs to be in the same direction as the developer conveyance direction (that is, upward). If the developing device 4 is structured so that the downstream magnetic portion 200*a* is weaker in magnetic force than the upstream magnetic portion 200*b*, the resultant magnetic force interferes with the force by which the developer is moved upward. Thus, the developing device 4 is likely to suffer from the developer overflow and/or the lockup of the developer conveyance. According to the studies made about this subject by the inventors of the present invention, when the difference in magnetic flux density between the downstream magnetic portion 200*a* and upstream magnetic portion 200*b* was set to 5 mT, the developer smoothly flowed, and the developer conveyance screws did not lock.

As for the reason why the difference in the amount of magnetic flux density should be set to no higher than 100 mT is for preventing the magnetic roller 45 in the development sleeve 44 from being affected by the magnetic field generated by the resultant magnetic force of the combination of the magnetic portions 200*a* and 200*b*. That is, if the permanent magnet 42*c* of the first developer conveyance screw 42 in the development chamber 41*a* is increased in magnetic flux density, the magnetic force of the magnetic roller 45 in the development sleeve 44, which is in the adjacencies of the first conveyance screw 42, is affected by the magnetic force of the permanent magnet 42*c*. Therefore, it is possible that the development sleeve 44 will fail to properly bear the developer. This is why the amount of the difference in the magnetic flux density was set to be no more than 100 mT. In consideration of the fact that a certain amount of latitude needs to be afforded to set the value for the amount of the difference in the magnetic flux density, the amount of the difference in magnetic flux density is desired to be set to a value in a range of 20-60 mT. For example, it is desired that the magnetic flux density of the permanent magnet 42*c* of the first conveyance screw 42 is set to be 80 mT (800 Gauss) at the surface of the magnet 42*c*, and the magnetic flux density of the permanent magnet 43*c* of the second conveyance screw 43 is set to be 20 mT (200 Gauss) at the surface of the magnet 43*c*.

The photosensitive drum member material, developer material, and image forming apparatus structure, and the like, do not need to be limited to those in this embodiment. In other words, the present invention is compatible with various developers which are different from the one used by the image forming apparatus in this embodiment, and also, various image forming apparatuses which are different from the one used in this embodiment, which is needless to say. That is, this embodiment is not intended to limit the present invention in terms of the toner color, number of developers (different in color), presence or absence of wax in the toner, order in which the latent images for the formation of multiple monochromatic toner images, different in color, are developed, number of the developer conveying-stirring members, amount of the magnetism of the carrier, etc.

Figure 6:
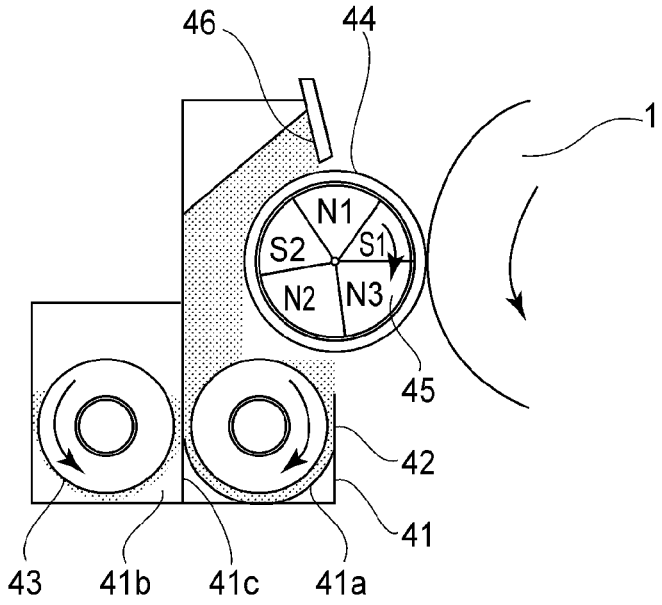
FIG. 6 is a schematic cross-sectional view of a developing device according to another embodiment of the present invention.
Figure 7:
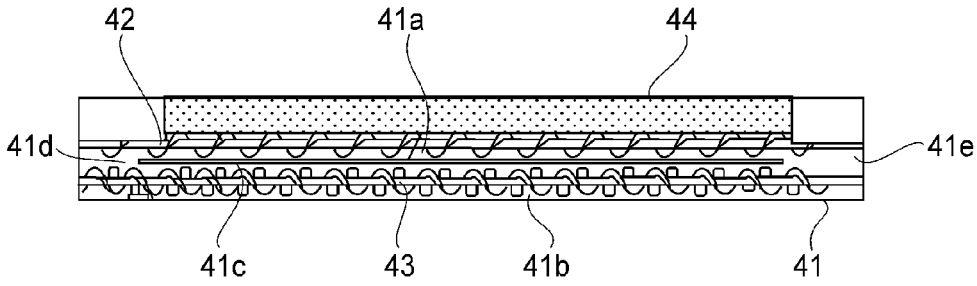
FIG. 7 is a longitudinal sectional view of the developing device.

Further, regarding the developing device structure, the development chamber 41*a* and stirring chamber 41*b* of the developing device 4 in this embodiment was vertically stacked. However, the present invention is also compatible with a developing device whose development chamber (41*a*) and stirring chamber (41*b*) are positioned side by side as shown in FIGS. 6 and 7, and developing devices structured differently from the developing device 4 in this embodiment and the developing device shown in FIGS. 6 and 7. Incidentally, the developing device shown in FIGS. 6 and 7 is virtually the same in structure as the developing device 4 in this embodiment, except that the development chamber (41*a*) and stirring chamber (41*b*) of the former are positioned side by side. Therefore, in FIGS. 6 and 7, the structural components, parts, etc., of the developing device are given the same referential codes as the counterparts of the developing device 4 in this embodiment. In a case where the portion of the developer conveyance screw 42, which corresponds in position to the developer transfer passage 41*d*, and the portion of the developer conveyance screw 43, which corresponds in position to the developer transfer passage 41*d*, are not provided with the magnetic portion, the permanent magnets 42*c* and 43*c* of the developer conveyance screws 42 and 43, respectively, may be made uniform in magnetic flux density in terms of their lengthwise direction. Further, in this embodiment, both of the lengthwise ends of the development chamber 41*a*, and both of the lengthwise ends of the stirring chamber 41*b*, were provided with the magnet. However, it may be only the downstream end of the development chamber 41*a*, which corresponds in position to the developer transfer passage, and the downstream end of the stirring chamber 41*b*, which corresponds in position to the developer transfer passage. This arrangement also can increase the efficiency with which the developer is conveyed through the developer transfer passage.

Embodiment 2

Figure 8:
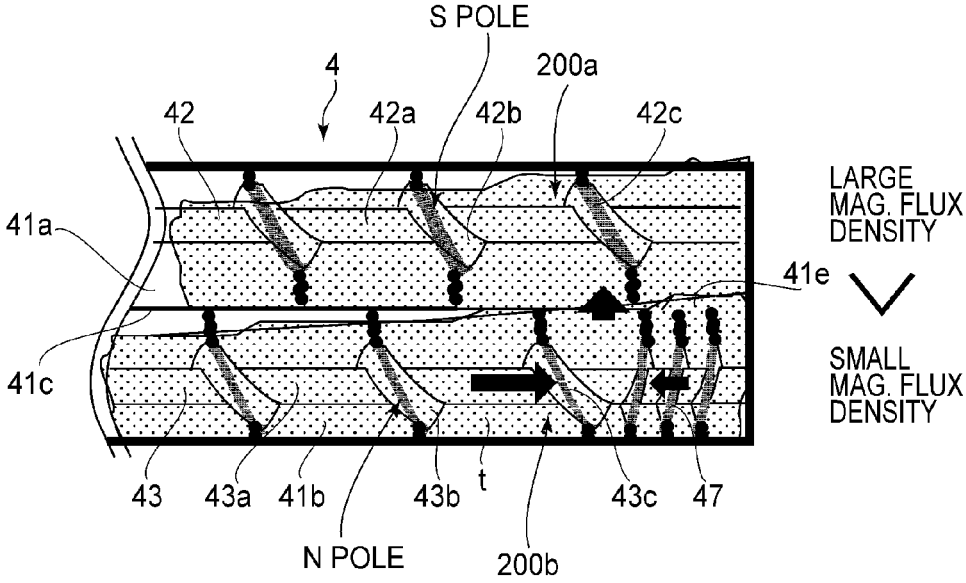
FIG. 8 is a schematic enlarged view of a right-hand portion of the FIG. 7, illustrating flow of the developer in the transferring portion.
Figure 9:
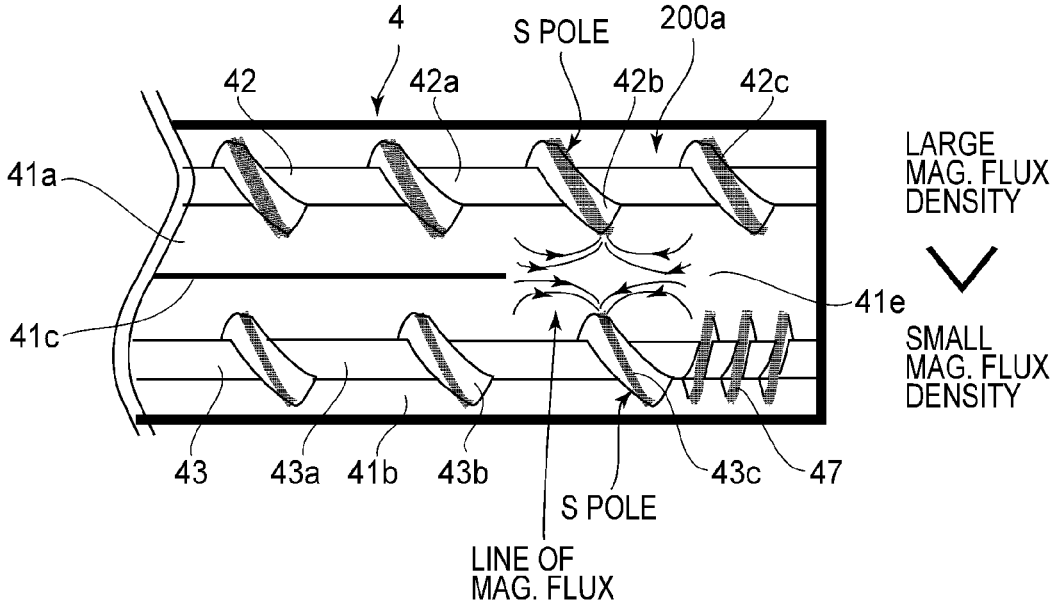
FIG. 9 is a schematic view where the same polarities poles are opposed interposing the transferring portion.
Figure 10:
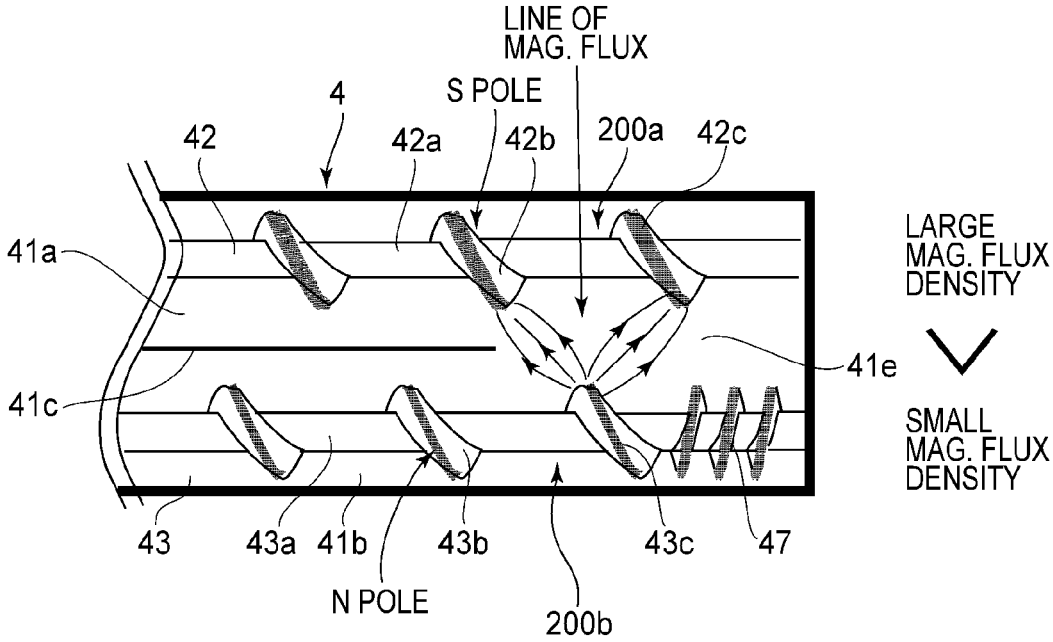
FIG. 10 is a schematic view where opposite polarity poles are opposed interposing the transferring portion.

Next, referring to FIGS. 8-10, the second preferred embodiment of the present invention is described. Since the image forming apparatus in this embodiment is the same in basic structure as the one in the first embodiment, its overall structure is not going to be described here. This embodiment is related to an image formation system which can be reduced in the speed of its developer conveyance screws to ensure that a toner image is properly fixed when thick recording paper is used as recording medium.

Some image forming apparatuses can be reduced in productivity to ensure that a toner image is properly fixed when recording medium which is larger in basis weight than ordinary recording medium, so-called coated paper, that is, glossy medium, or the like, is used as recording medium. Reducing an image forming apparatus in productivity means reducing the image forming apparatus in overall operational speed. In other words, it means that the developing device 4 also is reduced in operational speed. Thus, it means that the development sleeve 44, and first and second developer conveyance screws 42 and 43, in the developing device 4 are also reduced in speed.

As the first and second developer conveyance screws 42 and 43 are reduced in speed, the force generated upward, that is, the direction to push the developer upward, by the crash between the developer which is being conveyed backward by the spiral blade 47 of the second developer conveyance screw 43, and the developer which is being conveyed by the spiral blade 43*b*, reduces. Thus, the developing device reduces in the efficiency with which it transfers the developer between the development chamber 41*a* and stirring chamber 41*b*. Therefore, it is more likely for the developer to overflow, and/or for the developer conveyance screws to lockup than when the image forming apparatus is normal in operational speed. In the case of the image forming apparatus in this embodiment, its operational speed is reduced to ⅓ of the normal speed when thick recording medium, such as cardboard, is used as recording medium.

Therefore, in order to enhance the developing device in developer transfer performance, the developing device in this embodiment is structured so that at least, the magnetic poles on the entirety of the surface of the downstream magnetic portions 200*a*, which faces the developer transfer passage 41*e*, are the same in magnetic polarity, and also, so that the magnetic poles on the entirety of the surface of the upstream magnetic portion 200*b*, which faces the developer transfer passage 41*e*, are the same in polarity, but are different in polarity from those of the downstream magnetic portion 200*a*. For example, if the permanent magnet 42*c* of the downstream magnetic portion 200*a* is S in polarity, the permanent magnet 43*c* of the upstream magnetic portion 200*b* is N in polarity.

Here, the word "entirety" in the phrase "entirety of the surface of the magnetic portion 200*a* that faces the developer transfer passage 41*e*" means the entirety in terms of not only the lengthwise direction of the screws 42 and 43, but also, the circumferential direction of the screws 42 and 43. That is, regardless of the rotational angle of the developer conveyance screws 42 and 43, the magnetic poles on the portion of the downstream magnetic portion 200*a*, which corresponds in position to the developer transfer passage 41*e*, are the same in polarity, and the magnetic poles of the portion of the upstream magnetic portion 200*b*, which corresponds in position to the developer transfer passage 41*e*, are the same in polarity, but, are different in polarity from those on the downstream magnetic portion 200*a*.

The reason why the developing device in this embodiment was structured as described above is as follows. That is, if a developing device is structured, like the one in the first embodiment, so that the magnetic poles N and magnetic poles S are randomly positioned in the surface of the permanent magnet of the developer conveyance screw 42, and also, in the surface of the permanent magnet of the developer conveyance screw 43, it occurs sometimes that as the developer conveyance screws are rotated, a magnetic pole on the developer conveyance screw 42 faces a magnetic pole on the developer conveyance screw 43, which is the same in polarity as the one on the screw 42. If this happens, the two magnetic fields generated by the two magnetic poles repel each other, causing the developer to horizontally escape. In this situation, as long as the image forming apparatus is normal in the operational speed, and therefore, the developer conveyance screws 42 and 43 are normal in operational speed (higher than a certain value), the developer is smoothly conveyed in spite of the above described developer behavior. That is, as long as the developer conveyance screws 42 and 43 are higher in speed than a certain value, the force which is generated by the clash between the developer which is being conveyed by the spiral blade 47 (counter-conveyance blade) of the developer conveyance screw 43, and the developer which is being conveyed by the spiral blade 43*b* of the screw 43, and which works in the direction to flip the developer upward, is substantial. Thus, the developer is flipped upward across the magnetic field by this force, and is attracted by the downstream magnetic portion 200*a* in terms of the developer conveyance direction through the developer transfer passage 41*e*. In other words, the developer is smoothly transferred.

On the other hand, as the developer conveyance screws are reduced in speed, the force which is generated by the clash between the developer which is being conveyed by the spiral blade 47 (counter-conveyance blade), and the developer which is being conveyed by the spiral blade 43*b*, and which works in the direction to flip the developer upward, reduces to such a degree that the effect of the magnetic field becomes unignorable. Therefore, the developer stagnation occurs.

In this embodiment, therefore, the downstream magnetic portion 200*a* of the first developer conveyance screw 42 and the upstream magnetic portion 200*b* of the second developer conveyance screw 43 are made opposite in magnetic polarity in order to generate magnetic fields which always extend in the vertical direction as shown in FIG. 10. Therefore, the phenomenon that the developer is pushed back by the magnetic field generated as the magnetic pole of the developer conveyance screw 42, and the magnetic pole of the developer conveyance screw 43, which happens to oppose the former, become the same in polarity, does not occur. Therefore, even if the developer conveyance screws 42 and 43 reduce in speed, the developer is smoothly transferred through the developer transfer passage 41*e*.

Also in this embodiment, the portion of the developer conveyance screw 42, which corresponds in position to the developer transfer passage 41*d*, and the portion of the developer conveyance screw 43, which corresponds in position to the developer transfer passage 41*d*, are not provided with the magnetic portion. Instead, the developer conveyance screw 42 is provided with a permanent magnet 42*c*, which is S in surface magnetic polarity, whereas the developer conveyance screw 43 is provided with a permanent magnet 43*c* which is N in surface magnetic polarity. Further, the magnetic flux density of the permanent magnet 42*c* was set to 80 mT at the surface, whereas that of the permanent magnet 43*c* was set to 20 mT at the surface. However, the developing device may be structured so that the portion of the developer conveyance screw 42, which corresponds in position to the developer transfer passage 41*e*, and the portion of the developer conveyance screw 43, which corresponds in position to the developer transfer passage 41*e*, are provided with the magnetic portion, and the relationship between the two magnetic portions is the same as the relationship between the two magnetic portions which correspond in position to the developer transfer passage 41*e*. In such a case, the developing device may be designed so that all the magnetic poles at the surface of the permanent magnet 42*c* are S in polarity, and all the magnetic poles at the surface of the permanent magnet 43*c* are N in polarity. However, the lengthwise ends of each developer conveyance screw are made different in magnetic flux density.

As is evident from the description of the second embodiment of the present invention, the present invention can provide a developing device, in which even if the developer conveying-stirring member is reduced in speed in order to ensure that a toner image is properly fixed, the developer flow through the developer transfer passage is not impeded, the developer does not overflow, and the developer conveyance screws do not lockup, and also, which is higher in the efficiency with which the developer is conveyed through the developer transfer passages than any developing device in accordance with the prior art, which is needless to say.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 235437/2010 and 171086/2011 filed Oct. 20, 2010 and Aug. 4, 2011, respectively, which are hereby incorporated by reference.

What is claimed is:

1. A developing device comprising:

a developer carrying member for carrying developer containing a non-magnetic toner and a magnetic carrier to a position where said developer carrying member is opposed to an image bearing member;

a developing container including a first chamber for accommodating the developer to be supplied to said developer carrying member, a second chamber provided below said first chamber, and an opening for communication between said first chamber and said second chamber to circulate the developer between said first chamber and said second chamber;

a first feeding member and a second feeding member rotatably provided in said first chamber and said second chamber, respectively, for stirring and feeding the developer, with said first feeding member provided with a first magnet member at a position where the developer is taken up from said second chamber into said first chamber, and said second feeding member provided with a second magnet member at the position where the developer is taken up from said second chamber into said first chamber, wherein said first magnet member and said second magnet member are provided so that same magnetic polarity portions are opposed to each other or so that a ratio of a range in which the same magnetic polarity portions are opposed to each other is greater than a ratio of a range in which opposite magnetic polarity portions are opposed to each other.

2. A developing device comprising:

a developer carrying member for carrying developer containing a non-magnetic toner and a magnetic carrier to a position where said developer carrying member is opposed to an image bearing member;

a developing container including a first chamber for accommodating the developer to be supplied to said developer carrying member, a second chamber provided below said first chamber, and an opening provided at each of opposite end portions of said first chamber for communication between said first chamber and said second chamber to establish a circulation path through said first chamber and said second chamber;

a first feeding member and a second feeding member rotatably provided in said first chamber and said second chamber, respectively, for stirring and feeding the developer, with said first feeding member provided with a first magnet member at a position where the developer is taken up from said second chamber into said first chamber, and said second feeding member provided with a second magnet member at the position where the developer is taken up from said second chamber into said first chamber, wherein a magnetic flux density of said first magnet member is higher than that of said second magnet member.

3. A developing device according to claim 2, wherein a difference between a magnetic flux density of said first magnet member and that of said second magnet member is 5-100 mT.

4. A developing device according to claim 3, wherein a difference between a magnetic flux density of said first magnet member and that of said second magnet member is 20-60 mT.

* * * * *